US009458563B2

(12) United States Patent
Kegler et al.

(10) Patent No.: US 9,458,563 B2
(45) Date of Patent: Oct. 4, 2016

(54) FRONT LOADING WASHER BAFFLE

(71) Applicant: Alliance Laundry Systems LLC, Ripon, WI (US)

(72) Inventors: Andrew Kegler, Ripon, WI (US); Andrew Huerth, Green Lake, WI (US)

(73) Assignee: Alliance Laundry Systems LLC, Ripon, WI (US)

( * ) Notice: Subject to any disclaimer, the term of this patent is extended or adjusted under 35 U.S.C. 154(b) by 473 days.

(21) Appl. No.: 13/916,157

(22) Filed: Jun. 12, 2013

(65) Prior Publication Data

US 2014/0366587 A1 Dec. 18, 2014

(51) Int. Cl.
*D06F 37/06* (2006.01)

(52) U.S. Cl.
CPC ..... *D06F 37/06* (2013.01)

(58) Field of Classification Search
CPC ..... D06F 37/06; D06F 58/04
USPC ..... D32/26, 29
See application file for complete search history.

(56) References Cited

U.S. PATENT DOCUMENTS

2005/0102853 A1* 5/2005 Wang ..... D06F 58/04 34/602
2013/0081432 A1* 4/2013 Choi ..... D06F 37/14 68/142

* cited by examiner

*Primary Examiner* — Jason Ko
*Assistant Examiner* — Spencer Bell
(74) *Attorney, Agent, or Firm* — Leydig, Voit & Mayer, Ltd.

(57) ABSTRACT

A horizontal axis washing machine having a front opening clothes containing rotary basket with a plurality of elongated internally mounted baffles for agitating items within the basket during a washing operation. The baffles each have a solid outwardly extending rib which has a nonlinear curved configuration for defining a plurality of water lifting and agitating cavities on each side of the baffle. The cavities on one side of the baffle are effective for lifting and agitating wash water with a vortex movement as an incident to rotation of the basket in one rotary direction and the cavities on the opposite side of the baffle are operative for lifting and agitating water with an oppositely directed vortex movement as an incident to rotation of the basket in an opposite rotary direction.

9 Claims, 9 Drawing Sheets

FRONT LOADING WASHER BAFFLE

FIELD OF THE INVENTION

The present invention relates generally to washers/extractors for laundering items such as clothes, and more particularly, to a front opening horizontal axis, washing machine in which the clothes containing rotary basket has circumferentially spaced baffles for lifting and agitating items being laundered during a washing operation.

BACKGROUND OF THE INVENTION

To facilitate agitation of clothes or other items being laundered during a washing cycle, horizontal axis washing machines commonly have a clothes containing rotary basket with a plurality of circumferentially spaced V-shaped baffles mounted on an inner surface of the basket for engaging, lifting and agitating the items during washing. Such V-shaped baffles typically are fastened to the inner cylindrical surface of the basket in parallel relation to the rotary axis. Due to the V-shaped configuration of such baffles, water and residual detergents or softeners can become trapped between the inner wall of the wash basket and the baffle, which over time can cause mold and mildew or otherwise become stagnant and odorous. Attempts to solve the problem by providing drain holes in the baffles to permit the escape of trapped water have not been successful since the drain holes can become clogged due to build up of detergent, lint, and other debris in the wash water.

OBJECTS AND SUMMARY OF THE INVENTION

It is an object of the present invention to provide a horizontal axis washing machine having a rotary clothes retaining basket with lifting and agitating baffles which more effectively assist the washing operation and which do not trap or retain water, detergent, or other matter after a washing cycle.

Another object is to provide a washing machine as characterized above in which the rotary basket lifting and agitating baffles both agitate items being washed and direct water in a manner that enhances the cleaning of the washed items.

Still another object is to provide a washing machine of the above kind in which the rotary basket lifting and agitating baffles impart a vortex movement in the wash water as an incident to rotation of the basket for enhanced agitation and cleaning of items being laundered.

A further object is to provide a washing machine of the foregoing type in which the rotary basket lifting and agitating baffles direct water with vortex movement in opposite directions dependent upon the direction of rotary movement of the basket for further enhanced action on the laundered items.

Yet another object is to provide a washing machine in which the lifting and agitating baffles of the rotary basket are relatively simple in construction and lend themselves to economical manufacture and long term reliable usage.

Other objects and advantages of the invention will become apparent upon reading the following detailed description and upon reference to the drawings, in which:

Figure 1:
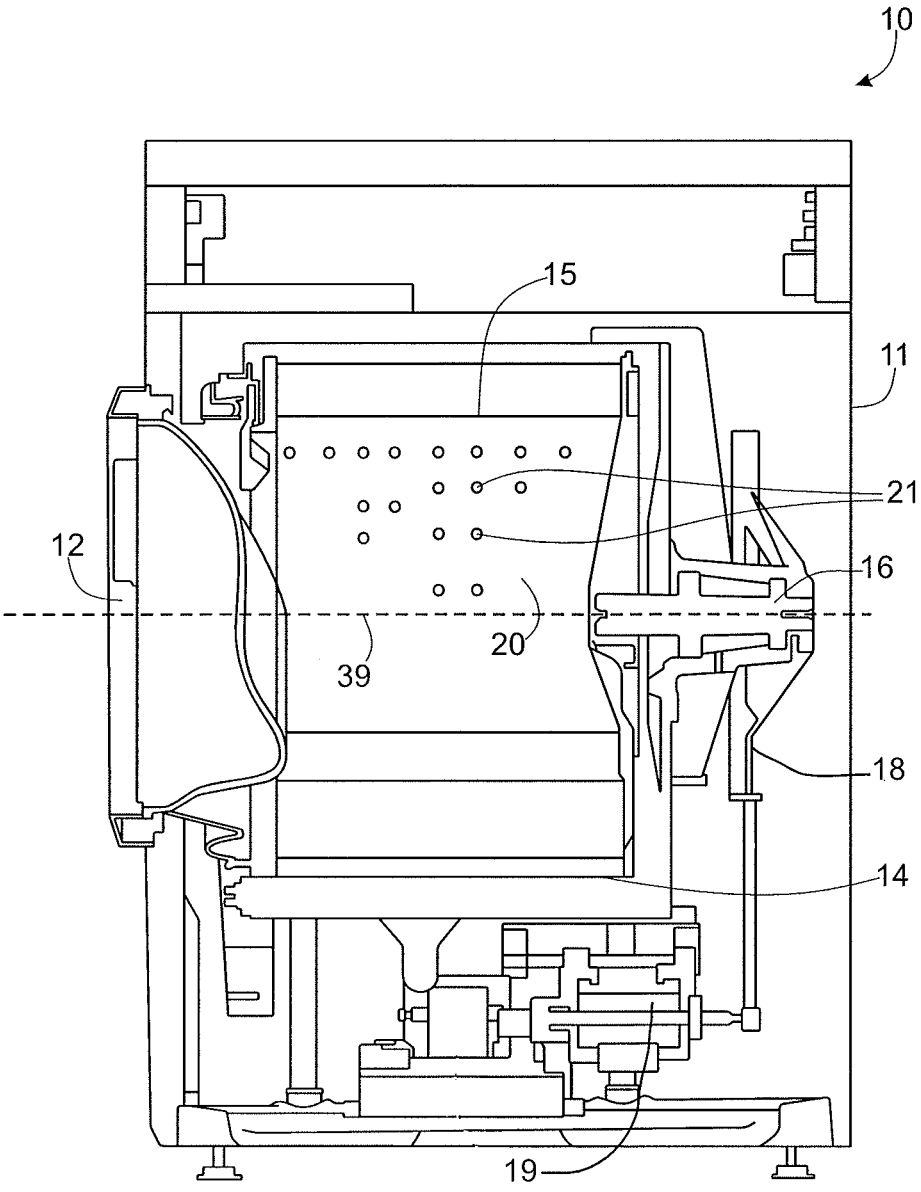
FIG. 1 is a partially diagrammatic, vertical section of a horizontal axis washing machine having a rotary basket with agitation baffles in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the invention is to cover all modifications, alternative constructions, and equivalents falling within the spirit and scope of the invention.

DESCRIPTION OF THE PREFERRED EMBODIMENT

Referring now more particularly to the drawings, there is shown an illustrative horizontal axis washing machine 10 in accordance with the invention. The illustrated washing machine 10 includes a cabinet or frame 11 with a front opening access door 12, a front opening outer tub 14 mounted within the frame 11 for receiving water and wash chemicals, and a front opening inner tub or basket 15 for receiving launderable items rotatably supported within the outer tub 14. For rotatably driving the inner basket 15, the inner basket 15 has a rearwardly extending drive shaft 16 of a trunnion assembly 17

(FIG. 2), driven via a pulley 18 from a motor 19 located below the outer tub 14. It will be understood by one skilled in the art that the basic construction and operation of such washing machine is well known in the art. In that regard, it is known to operate the drive motor 19 for successively rotating the clothes containing basket 15 in opposite rotary directions during a washing operation to facilitate agitation and cleaning of the contained launderable items.

Figure 2:
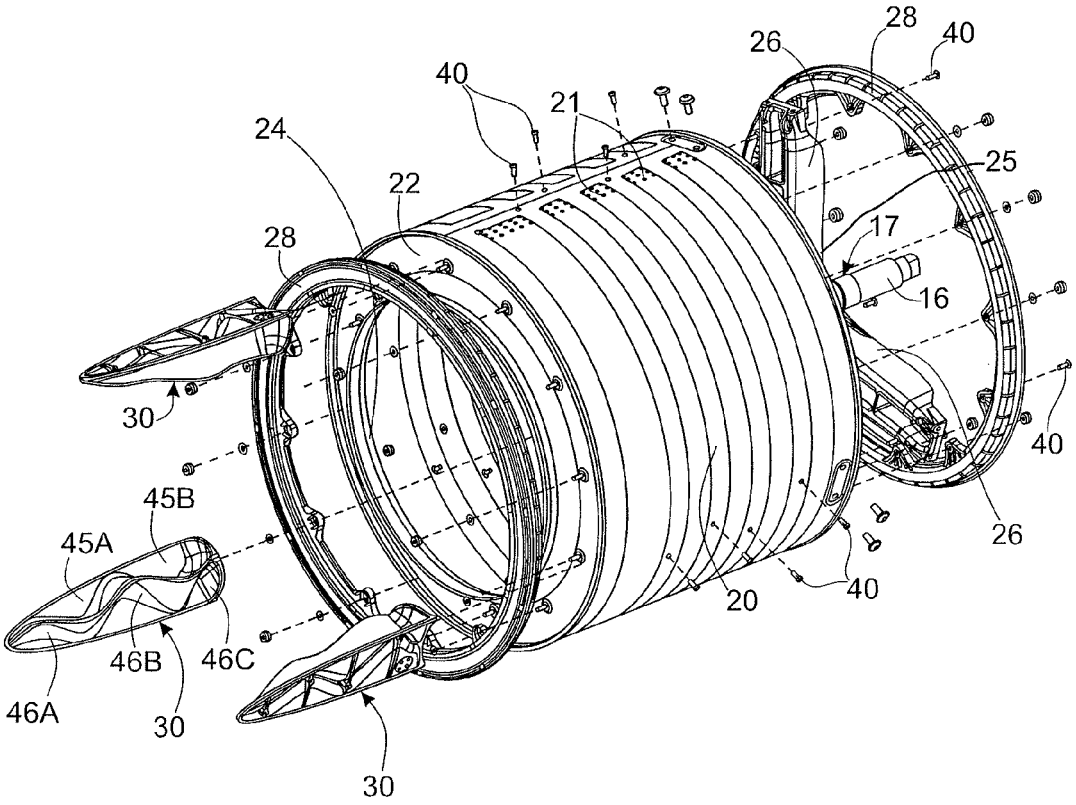
FIG. 2 is an enlarged exploded perspective of the rotary basket of the illustrated washing machine.
Figure 3:
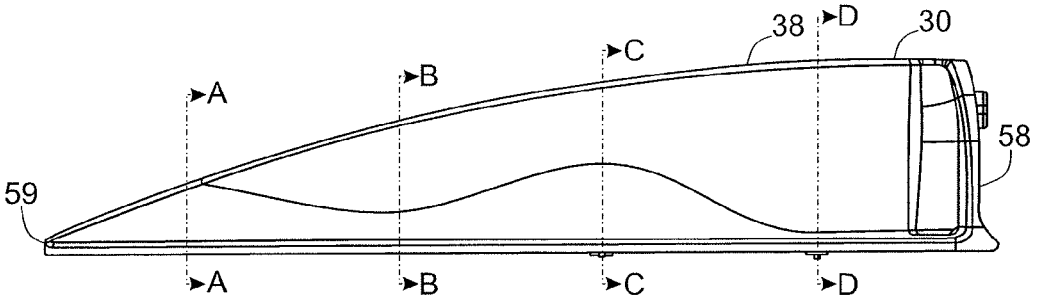
FIG. 3 is an enlarged side elevational view of one of the agitation baffles of the rotary basket shown in FIG. 2.

The inner basket 15, as best depicted in FIG. 2, comprises a cylindrical side wall 20 formed with perforations 21 which permit entry of wash water from the wash tub 14 into and through the inner basket 15, an annular front 22 extending radially inwardly from the cylindrical side wall 20 defining a front opening 24 of the inner wash basket 15, and a circular back panel 25 fixed to a rear end of the rotary basket 15. The back panel 25 of the wash basket 15 further is fixed to three radial legs 26 of the drive shaft trunnion assembly 17 in a conventional manner. Balance rings 28 in this case are affixed adjacent front and back ends of the rotary basket 15 for facilitating balancing of rotary movement of the basket 15 in a conventional manner.

In accordance with the invention, the inner rotary basket 15 has a plurality of circumferentially spaced lifting and agitating baffles 30 which are designed to enhance agitation of both the items being laundered and the wash water without retaining water, detergents and debris after a washing cycle which over time can cause mold, mildew, and undesirable odors. To this end, the lifting and agitating baffles 30 in this case have an elongated base 31 for mounting within the rotary basket 15 and a solid outwardly extending agitating rib 35 for lifting and moving lauderable items within the rotary basket 15 as an incident to rotation of the basket 15 during a washing operation. The ribs 35 in this instance have a solid flange like construction with parallel side walls 36 that terminate along an outer peripheral edge 38 of the rib 35 (See FIG. 8 for example). By reason of the solid construction of the rib 35 and base 31, as will become apparent, the baffles 30 are incapable of undesirably trapping or retaining water, detergents, or debris following a washing operation. The illustrated rotary basket 15 has three such lifting and agitating baffles 30 disposed in circumferentially spaced relation about an inner side of the basket 15. The baffles 30 are oriented parallel to a rotary axis 39 of the basket 15 and are affixed both to the inner side of the cylindrical side wall 20 of the rotary basket 15 and the ends of the trunnion assembly legs 26 by fastening screws 40 or the like.

Figure 10:
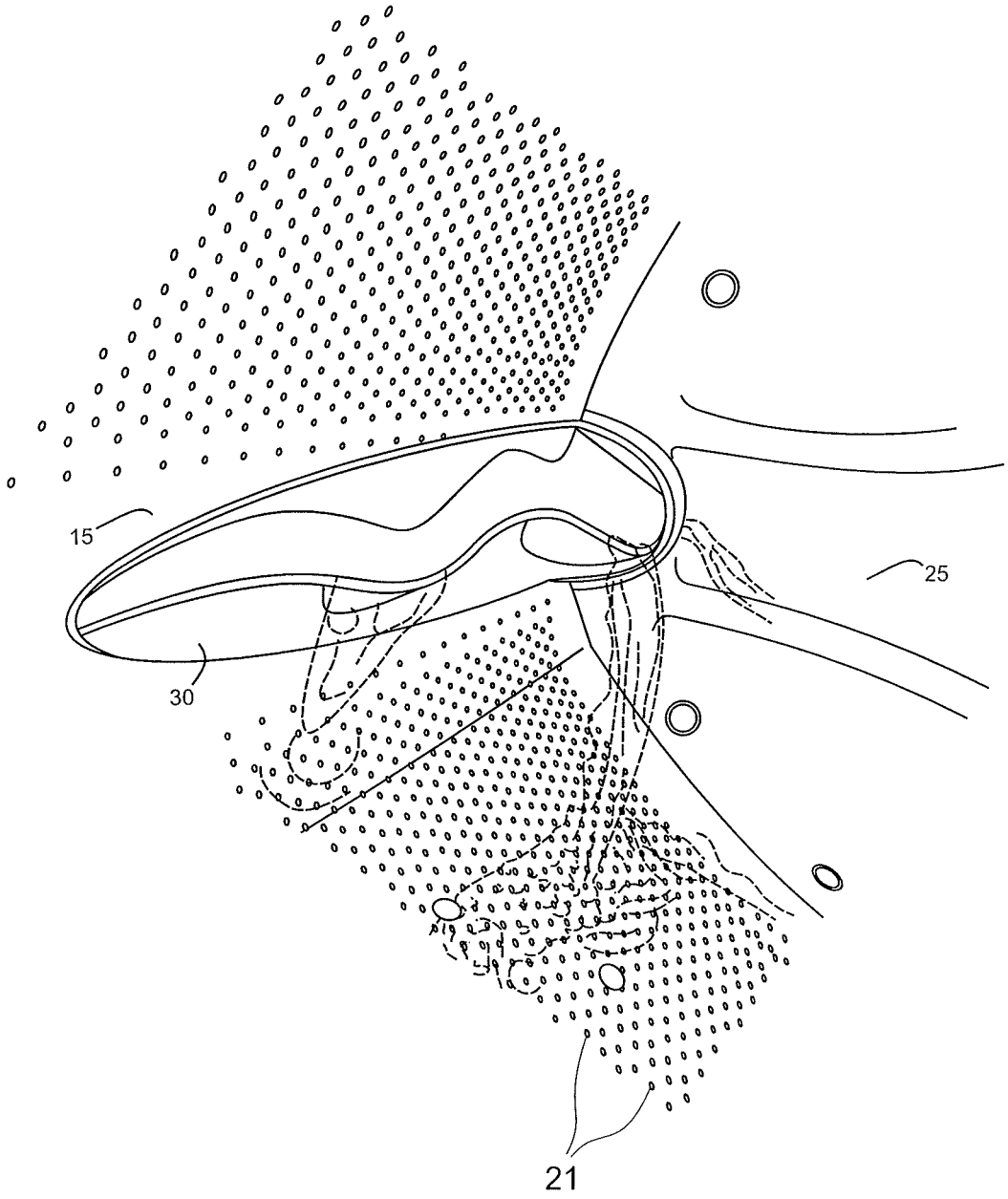
FIG. 10 is a perspective similar to FIG. 9, showing the action of the baffle on water as an incident to rotation of the basket in one rotary direction.
Figure 11:
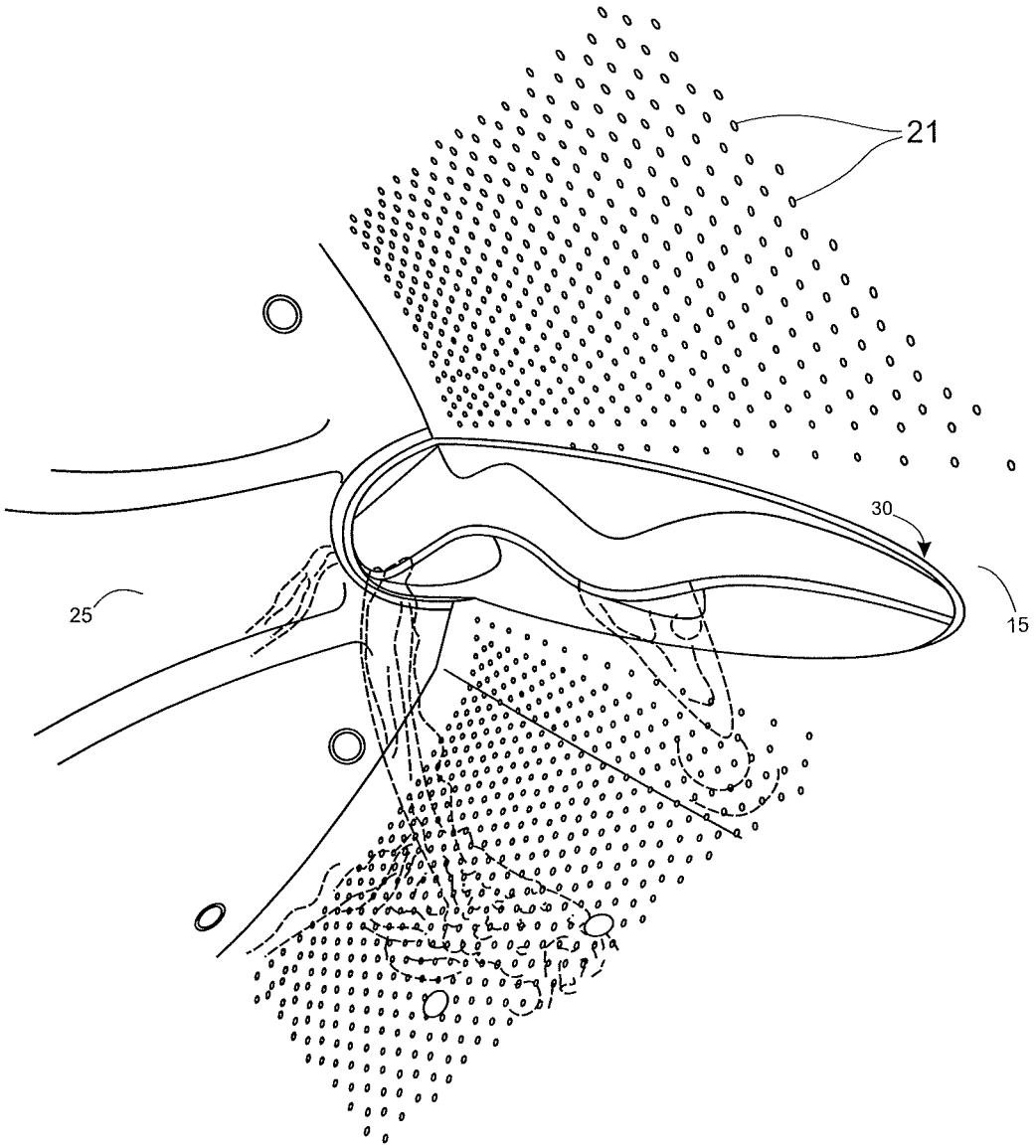
FIG. 11 is a perspective similar to FIG. 10 showing the action of the baffle on water as an incident to rotation of the basket in an opposite rotary direction.

In keeping with this embodiment, the agitating rib 35 of each baffle 30 has a nonlinear configuration along its elongated length which defines at least one, and preferably a plurality of pockets or cavities on each side of the baffle 30 for lifting and directing wash water in an agitating fashion as an incident to rotation of the rotary basket 15 during a washing operation. In the illustrated embodiment, each rib 35 is formed with a plurality of serpentine like curved sections along its longitudinal length which define two water carrying and directing pockets or cavities 45A, 45B on one side of the baffle 30 and three water containing and directing pockets or cavities 46A, 46B, 46C (FIG. 4) on the opposite side of the baffle 30 such that wash water within the tub 14 and basket 15 is further raised and agitated by the baffles 30 regardless of the direct rotary direction of movement of the basket 15. More particularly, upon rotation in a clockwise direction, as viewed in FIGS. 2 and 10, the pockets 45A, 45B on one side of the baffle 30 will contain, lift, direct, and agitate the water during washing, and upon rotation of the basket 15 in the opposite rotary direction (FIGS. 2 and 11), the pockets 46A, 46B, 46C will similarly contain, lift, direct, and agitate the wash water.

In carrying out this embodiment, the water retaining cavities or pockets of the baffle 30 are defined by forming the outer perimeter or edge 38 of the rib 35 in a first sinusoidal shape or line 50 along the elongated length of the rib 35 and forming the bottom of the rib 35 in a different sinusoidal shape or line 51 of greater magnitude than the sinusoidal shape of the line 50 of the outer perimeter. With the rib 35 formed in such manner, it can be seen that the wall of the rib that define the cavities 46A, 46B and 46C is inclined to the right as viewed in FIG. 8C for containing, lifting, and directing water when the rotary basket is rotated in one direction, and the wall of the curved sections of the rib 35 that define the cavities 45A, 45B are inclined in an opposite direction for lifting and directing water when the basket is rotated in an opposite direction. With the sinusoidal shapes along lines 50 and 51 being in relation to a long axis of the rib 35, it will be understood that when the sinusoidal lines pass through the center line the wall is radially oriented at that point in the transition to the inclination of the wall.

Figure 4:
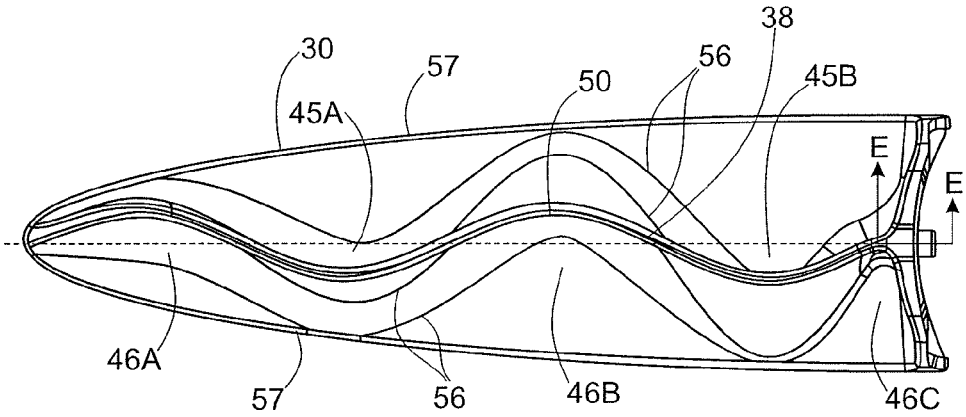
FIG. 4 is a top plan view of the baffle shown in FIG. 3.
Figure 5:
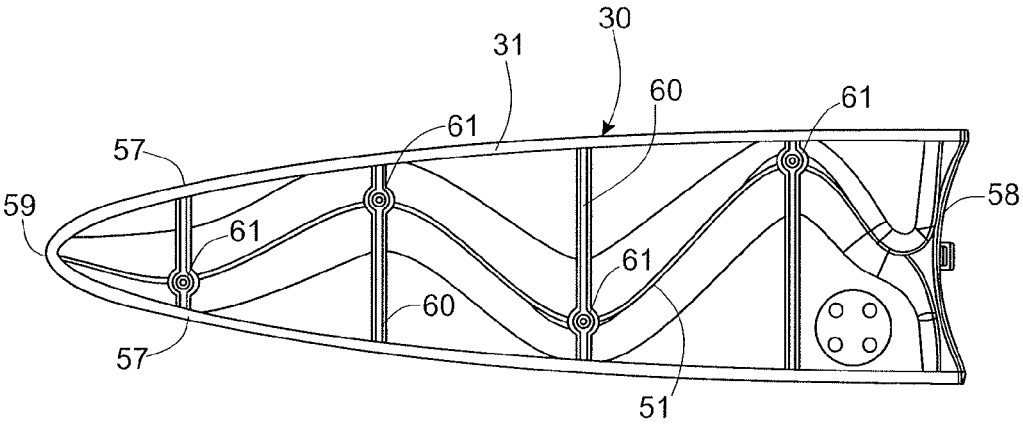
FIG. 5 is a bottom plan view of the baffle shown in FIG. 3.
Figure 6:
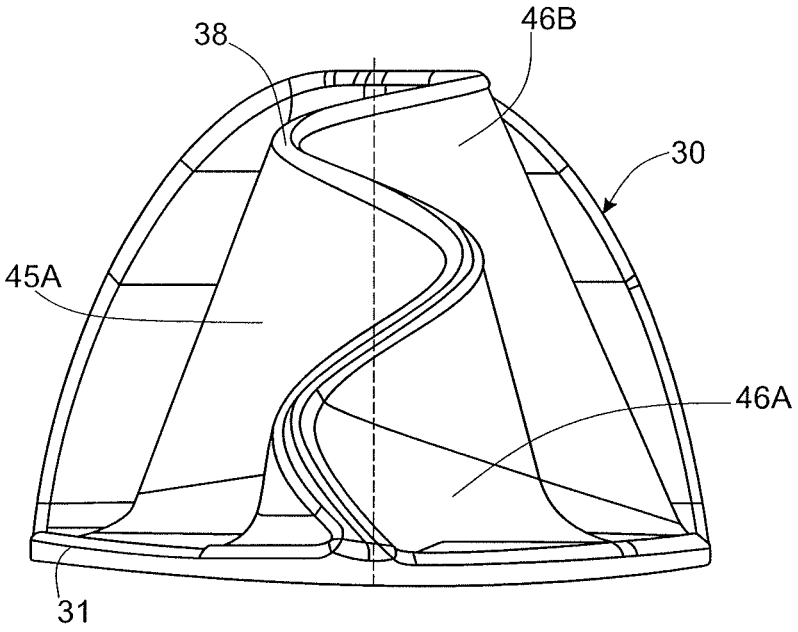
FIG. 6 is a left side elevational view of the baffle shown in FIG. 3.
Figure 7:
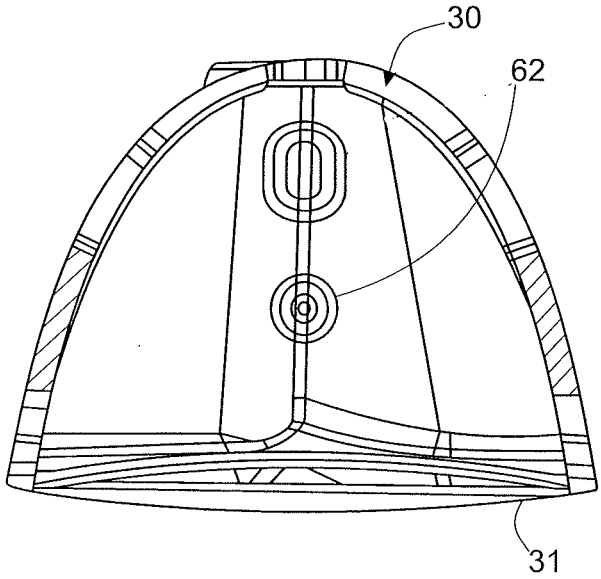
FIG. 7 is a right side elevational view of the baffle shown in FIG. 3.
Figure 8A:
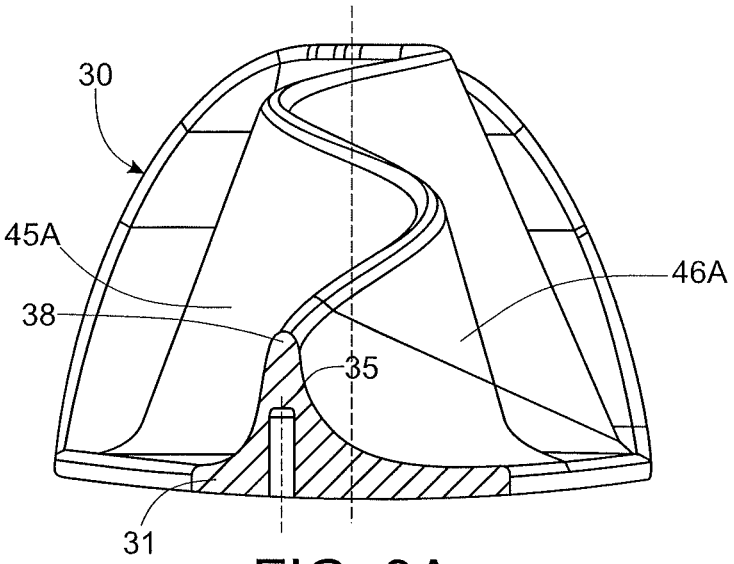
FIGS. 8A-8D are vertical sections of the baffle shown in FIG. 3 taken in the planes of line AA, BB, CC, and DD respectively.
Figure 8B:
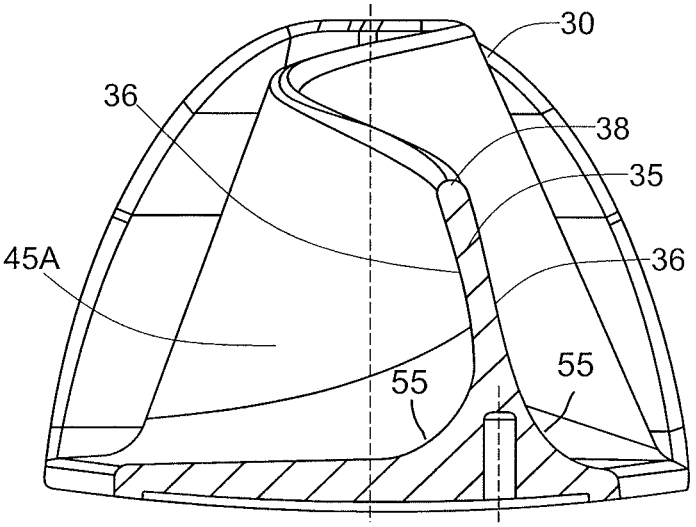
Figure 8C:
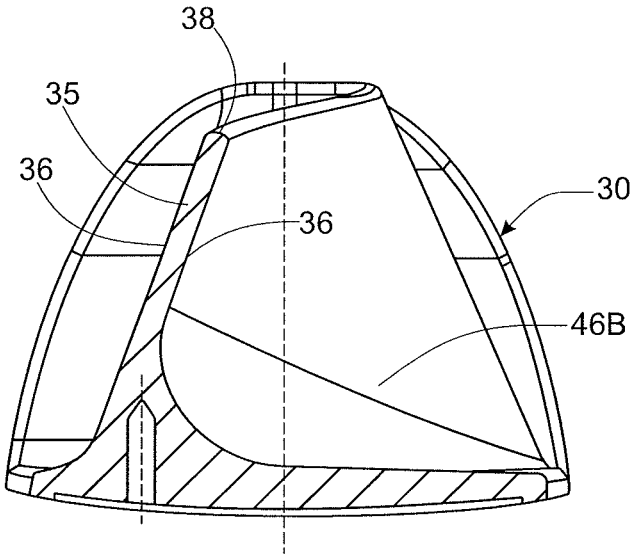
Figure 8D:
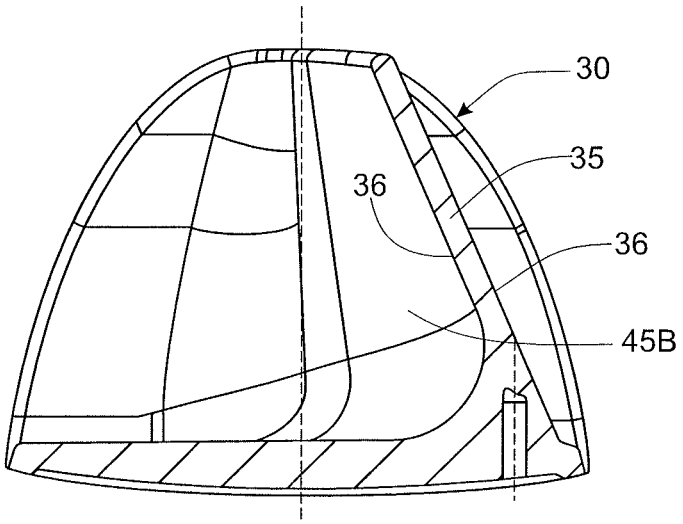
Figure 9:
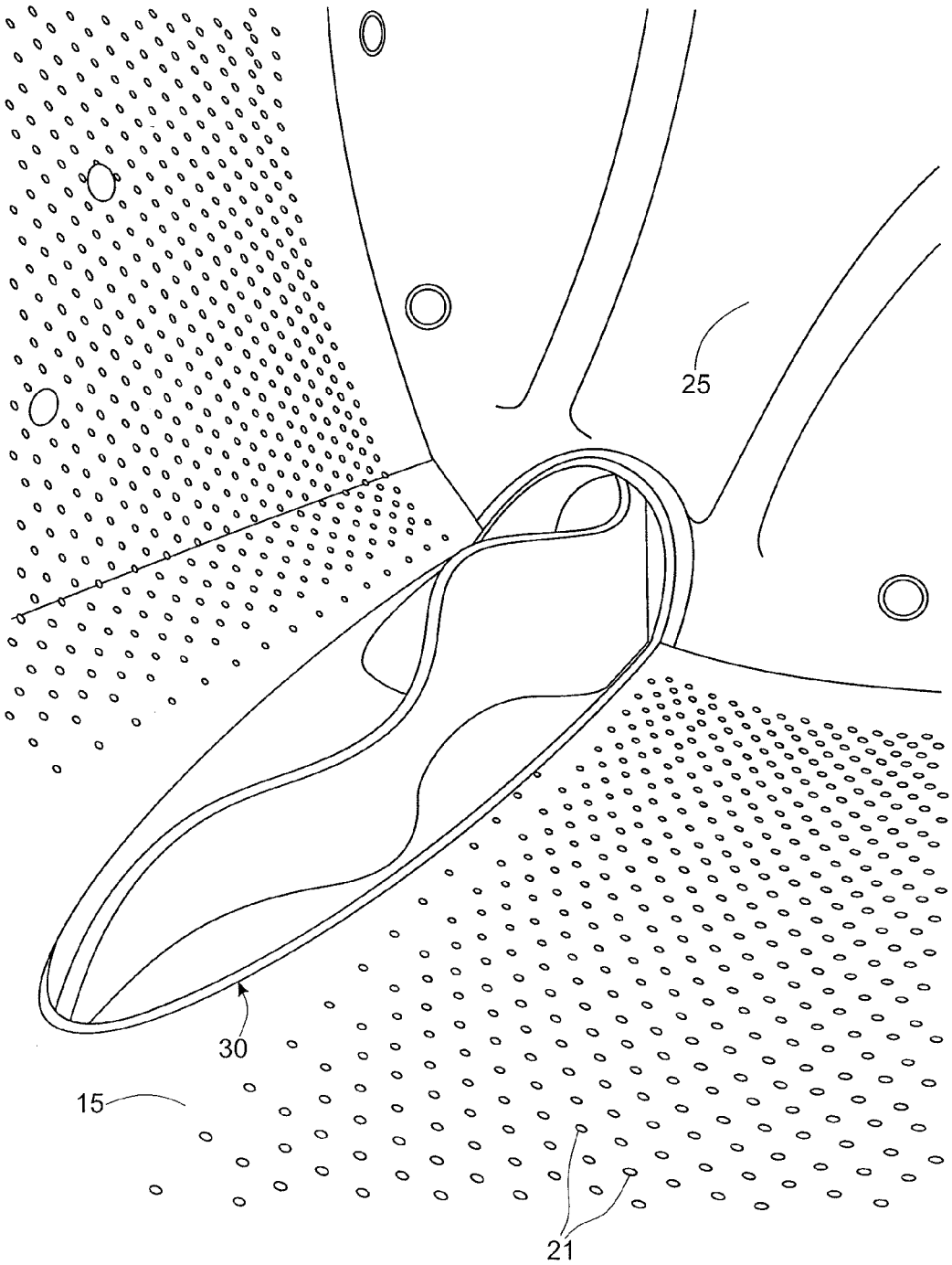
FIG. 9 is an enlarge fragmentary perspective showing one of the baffles in mounted condition in the rotary basket.

For enhancing rigidity of the baffle 30, the side wall 36 of the agitating rib 35 joins the base with curved sections 55 (FIG. 8B) that blend the rib 35 and base 31 along tangent lines 56, as depicted in FIG. 4. The outer peripheral edge 38 of the rib 35 also is tapered in a downward direction from a back end 58 to the front terminal end 59 of the baffle 30. The rib 35 in this case has a height adjacent the back end of the baffle which corresponds nearly to the width at that location and tapers downwardly to the level of the base 31 at the front terminal end 59. The base 31 of the baffle 30 also has rounded sides 57 that taper inwardly toward each other in a direction from the back end of the baffle to the front terminal end thereof (FIGS. 4 and 5). While in the illustrated embodiment the curved transition sections 55 between the rib 35 and the base 31 may define a slight serpentine configured recess in the underside of the base, it is not susceptible for retaining water following a washing operation since it is mounted on the perforated wall of the rotary basket 15 which assures drainage. In this case, a plurality of small transverse reinforcing flanges 60 (FIG. 5) extends transversely across the underside of the baffle 30, each of which is formed with a respective annular collar 61 for receiving a respective fastener 40. The back end 58 of the baffle 30 similarly is formed with collars 62 (FIG. 7) for receiving fasteners 40 for retention of the back panel 25 of the rotary basket 15 to the trunnion legs 26.

In carrying out a further feature of this embodiment, the water carrying cavities 45A, 45B on one side of the vein are designed to contain and lift the same quantity of water as the cavities 46A, 46B, 46C on the opposite side of the vein. Even though the water lifting cavities are not uniform in size, and particularly the relatively small cavity 46C adjacent the back end of the baffle 15, the cavities on one side of the baffle are designed to receive and lift a similar total quantity of water, such as 4 oz., as the cavities on the opposite side of the vein. Hence, regardless of the direction of rotation of the rotary basket, similar quantities of wash water are lifted, redirected and agitated by the veins.

In keeping with still a further feature of the illustrated embodiment, the water containing and lifting cavities or pockets 45A, 45B and 46A, 46B, 46C defined by the curved sections of the rib 35 have been found to generate a vortex or whirlpool effect in the wash water as an incident to movement through the wash water during rotation of the basket 15 for further enhancing cleaning of contained items. More particularly, the water retaining pockets 45A, 45B on one side of the rib 35 have been found to produce a vortex movement in the wash water in one rotary direction in response to rotation of the basket in one direction, and the rotary pockets 46A, 46B, 46C on the opposite side of the rib 35 have been found to generate a vortex swirling movement in the wash water as the result of rotation of the rotary basket 15 in an opposite rotary direction. Accordingly, the baffles 30 have been found to be effective not only for lifting and agitating the items within the rotary basket during laundering, but also for agitating and positively direct the wash water in a manner that further enhances cleaning of the launderable items. Yet it will be appreciated by one skilled in the art that while the baffles 30 have significant utility in agitation of both the items being washed and the wash water, they remain of relatively simple design and can be economically produced by plastic injection molding.

The invention claimed is:

1. A washing machine for washing launderable items comprising:

a cabinet;

a front opening outer tub mounted within said cabinet for receiving wash water during a washing operation;

a front opening inner basket mounted for rotation about a horizontal axis within said outer tub;

a drive for selectively rotating said inner basket in opposite: rotary directions during a washing operation;

a plurality of elongated baffles mounted within said basket for engaging and agitating the items within the basket during a washing operation, said elongated baffles each having a length from a front to a rear of each baffle;

said baffles each having a base at a bottom portion thereof, the base mounted on an inner side wall of the basket, said baffles each having a single solid uninterrupted agitating rib integral with and extending outwardly from the base at the bottom portion of each baffle and terminating at a peripheral edge at a top portion of each baffle;

said solid rib of each baffle having side surfaces for directly contacting and agitating wash water and launderable items within the basket as an incident to rotation of the basket, at least a portion of the side surfaces being parallel side surfaces;

said parallel side surfaces extend along the elongated baffle for at least one-half the length of the elongated baffle and extend from the bottom portion to the top portion for a distance of at least one-half the height from the base to the peripheral edge;

said solid agitating rib of each baffle having a nonlinear configuration along its length defining at least one water lifting and directing cavity on each side of said baffle; and said at least one cavity on one side of said baffle being effective for lifting and directing wash water as an incident to rotation of the basket in one rotary direction and said at least one cavity on an opposite side of said baffle being effective for lifting and directing water as an incident to rotation of the basket in an opposite rotary direction, wherein the peripheral edge of each solid rib defines a first sinusoidal curved line and each solid rib has a bottom adjacent the base that defines a second sinusoidal line of greater amplitude than the sinusoidal line defined by the peripheral edge.

2. The washing machine of claim 1 in which each said baffle is mounted within said rotary basket in aligned relation to the rotary axis of the basket and with one end of the baffle adjacent a back end of the basket, and the peripheral edge of the rib of each baffle tapering toward the base of the baffle at an opposite end.

3. The washing machine of claim 2 in which said parallel side surfaces of said ribs join said base with curved transition corners.

4. The washing machine of claim 1 in which said solid rib of each baffle defines a plurality of said water lifting and directing cavities on each side of the rib.

5. The washing machine of claim 4 in which said water lifting and directing cavities on one side of said rib direct a similar total quantity of water an incident to rotation of the basket in said one rotary direction as the water lifting and directing baffles on the opposite side of the solid rib lift and direct as an incident to rotation of the basket in the opposite rotary direction.

6. The washing machine of claim 4 in which at least one of the water directing cavities on one side of said solid rib is sized differently than the water directing cavities on the opposite side of the rib.

7. The washing machine of claim 4 in which the water lilting and directing cavities are operable for creating a vortex swirling movement in the wash water within the tub and basket as an incident to rotation of the basket.

8. The washing machine of claim 7 in which the water lifting and directing cavities on one side of the solid rib are effective for creating a vortex swirling movement in a first direction as an incident to rotation of said basket in said one direction, and said water lifting and directing cavities on an opposite side of the solid rib are effective for creating a vortex movement in an opposite swirling direction as an incident to rotation of the basket in an opposite rotary direction.

9. The washing machine of claim 1 in which said side walls of the solid rib that define the water lifting and directing cavities on one side of said solid rib taper in an opposite direction to the base of the baffle than side walls of the solid rib that define the water lifting and directing cavities on an opposite side of the rib.

* * * * *